US007455114B2

(12) United States Patent
MacDougall

(10) Patent No.: US 7,455,114 B2
(45) Date of Patent: Nov. 25, 2008

(54) SNORKEL DEVICE FOR FLOW CONTROL

(75) Inventor: Thomas D. MacDougall, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 289 days.

(21) Appl. No.: 10/905,876

(22) Filed: Jan. 25, 2005

(65) Prior Publication Data

US 2006/0162935 A1 Jul. 27, 2006

(51) Int. Cl.
*E21B 34/00* (2006.01)

(52) U.S. Cl. ..... 166/373; 166/316; 166/319; 166/243

(58) Field of Classification Search ..... 166/321, 166/316, 373–375, 319, 386, 72, 387, 54.1; 73/152.23
See application file for complete search history.

(56) References Cited

U.S. PATENT DOCUMENTS

| | | | | | |
|---|---|---|---|---|---|
| 2,307,949 | A | | 1/1943 | Phillips | |
| 3,109,376 | A | * | 11/1963 | Massey | 166/54.1 |
| 3,454,029 | A | | 7/1969 | Fredd | |
| 3,847,214 | A | * | 11/1974 | Cushman | 166/319 |
| 3,967,647 | A | | 7/1976 | Young | |
| 3,993,100 | A | | 11/1976 | Pollard et al. | |
| 4,084,613 | A | | 4/1978 | Peters | |
| 4,217,934 | A | | 8/1980 | Peters | |
| 4,258,786 | A | | 3/1981 | Lochte et al. | |
| 4,402,517 | A | | 9/1983 | Wood et al. | |
| 4,437,514 | A | * | 3/1984 | Canalizo | 166/72 |
| 4,524,831 | A | | 6/1985 | Pringle | |
| 4,621,695 | A | | 11/1986 | Pringle | |
| 4,660,646 | A | | 4/1987 | Blizzard | |
| 4,660,647 | A | | 4/1987 | Richart | |
| 4,745,802 | A | | 5/1988 | Purfurst | |
| 4,770,250 | A | | 9/1988 | Bridges et al. | |
| 4,879,900 | A | | 11/1989 | Gilbert | |
| 5,050,681 | A | | 9/1991 | Skinner | |
| 5,058,673 | A | | 10/1991 | Muller et al. | |
| 5,230,244 | A | * | 7/1993 | Gilbert | 73/152.23 |
| 5,323,853 | A | | 6/1994 | Leismer et al. | |
| 5,529,126 | A | | 6/1996 | Edwards | |
| 5,826,661 | A | | 10/1998 | Parker et al. | |
| 5,832,996 | A | | 11/1998 | Carmody et al. | |
| 5,947,205 | A | | 9/1999 | Shy | |
| 5,957,207 | A | | 9/1999 | Schnatzmeyer | |
| 5,971,004 | A | | 10/1999 | Pringle | |
| 6,012,518 | A | | 1/2000 | Pringle et al. | |
| 6,085,845 | A | | 7/2000 | Patel et al. | |
| 6,119,783 | A | | 9/2000 | Parker et al. | |
| 6,209,636 | B1 | | 4/2001 | Roberts et al. | |
| 6,302,210 | B1 | | 10/2001 | Crow et al. | |

(Continued)

FOREIGN PATENT DOCUMENTS

| | | | |
|---|---|---|---|
| CA | 2509928 | A1 | 12/2005 |

(Continued)

*Primary Examiner*—Richard E Chilcot, Jr.
*Assistant Examiner*—Matthew J Smith
(74) *Attorney, Agent, or Firm*—Van Someren, PC; Daryl R. Wright; Bryan P. Galloway

(57) ABSTRACT

The present invention provides for the operation of a downhole flow control device using a snorkel tube.

17 Claims, 2 Drawing Sheets

U.S. PATENT DOCUMENTS

| | | | | |
|---|---|---|---|---|
| 6,328,109 | B1 | 12/2001 | Pringle et al. | |
| 6,502,640 | B2 | 1/2003 | Rayssiguier et al. | |
| 6,523,613 | B2 | 2/2003 | Rayssiguier et al. | |
| 6,691,785 | B2 | 2/2004 | Patel | |
| 6,866,101 | B2 * | 3/2005 | Sloan | 166/375 |
| 7,201,226 | B2 * | 4/2007 | Gambier | 166/387 |
| 2002/0029890 | A1 | 3/2002 | Patel | |
| 2002/0074129 | A1 | 6/2002 | Moore | |
| 2004/0050555 | A1 | 3/2004 | Rayssiguier at al. | |
| 2006/0016593 | A1 | 1/2006 | Gambier | |

FOREIGN PATENT DOCUMENTS

| | | | |
|---|---|---|---|
| EP | 199503 | B1 | 10/1991 |
| GB | 2415213 | A | 12/2005 |
| WO | 2002029205 | A1 | 4/2002 |

* cited by examiner

SNORKEL DEVICE FOR FLOW CONTROL

BACKGROUND OF THE INVENTION

1. Field of Invention

The present invention pertains to downhole flow control devices, and particularly to downhole flow control devices using a common control line as a pressure source for operation.

2. Related Art

In running intelligent completions into subterranean wells, there are often limitations on the number of control line penetrations that can be made at the wellhead, the tubing hanger, or, in some cases, the production packer.

Intelligent completions use various means to regulate flow control devices placed downhole to control production from various zones. Such flow control devices, valves, for example, can typically be fully open, partially open (choked), or fully closed. Using a plurality of such valves allows an operator to selectively receive or restrict production from different zones. A simple version of such a flow control device would typically have two control lines, one acting on either side of a piston. When multiple valves of that kind are run in the hole, the number of control lines required becomes a problem. For example, three valves would require six control lines.

There also exist single control line flow control devices that rely on energy stored in the downhole device, such as a charge of compressed gas (e.g., nitrogen spring) or a mechanical spring working in conjunction with either the annular or tubing pressure. Since downhole conditions may change over time, selection of the spring or nitrogen charge is critical and may limit the operational envelope of the flow control device. Various multiplexing schemes have been employed, but those typically require some complex scheme of valves to allow pressures at different levels to address one valve or another. A common return line has been proposed for simple, two position-type valves (i.e., open/close valves), but operation can be tricky as one must carefully assess the state of each valve to determine the proper pressure sequence to apply to the various control lines at surface.

SUMMARY

The present invention provides for the operation of a downhole flow control device using a snorkel.

Advantages and other features of the invention will become apparent from the following description, drawings, and claims.

DETAILED DESCRIPTION

Figure 1:
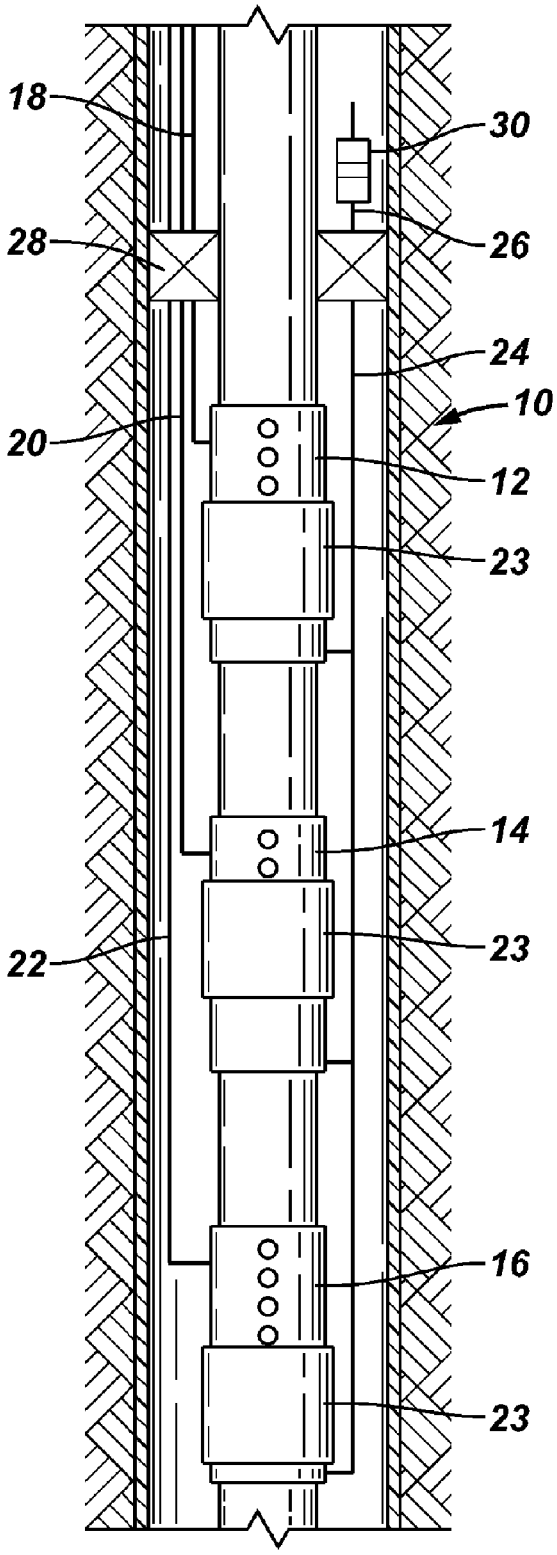
FIG. 1 shows a schematic view of a snorkel device constructed in accordance with the present invention.

FIG. 1 shows a snorkel device 10 being used to operate a set of valves such as multi-position hydraulic valves 12, 14, 16 in a well. The valves could also be on/off valves. The invention is not limited to use on valves, however. For example, the flow control device could be a choke. Each valve 12, 14, 16 has a control line 18, 20, 22, respectively, and an indexer 23 to shift the valve to each of its various state positions. A snorkel 24 is joined to each valve 12, 14, 16. Snorkel 24 is preferably a small diameter tubing such as that commonly used for a control line. Snorkel 24 may be run to the surface, but preferably terminates at its upper end 26 just above a production packer 28. If upper end 26 of snorkel 24 terminates at some level in the well, a compensator 30 may be joined to upper end 26 to prevent co-mingling of wellbore fluids with clean hydraulic fluid. Compensator 30 allows fluid pressure in the annulus to be transferred to the hydraulic fluid in snorkel 24 without co-mingling. Though shown joined at upper end 26, compensator 30 may be located anywhere in snorkel 24.

In operation, valve 12, for example, uses indexer 23 to advance the valve state (e.g., from partially open to fully open) one position each time sufficient pressure is applied to control line 18. Indexer 23 is moved by a piston (not shown) being driven by hydraulic pressure. To further advance the state position of the valve, the pressure in control line 18 is lowered and pressure is supplied to the backside of the piston to reset indexer 23. The resetting force may be reinforced by a spring force, as is known in the art. Pressure can then be applied to control line 18 again, driving the piston and thereby advancing indexer 23 and the valve state. Valves 14, 16 operate similarly via control lines 20, 22, respectively.

Snorkel 24 is in fluid communication with the backside of the piston in each valve 12, 14, 16. Hydraulic pressure in snorkel 24 provides a return force to each piston. If snorkel 24 terminates at its upper end at some level in the well, the fluid pressure in the well at that particular level serves as the source of the hydraulic pressure applied to the backside of each piston. The pressure at that particular level could be the ambient hydrostatic pressure, or it could be modified by changing the annular pressure at the surface using conventional methods. The fluid pressure in snorkel 24 establishes a reference pressure against which downhole tools may be operated.

In the embodiment of FIG. 1, three downhole flow control devices are shown. However, the invention is not limited to three and may be used with as few as one.

Figure 2:
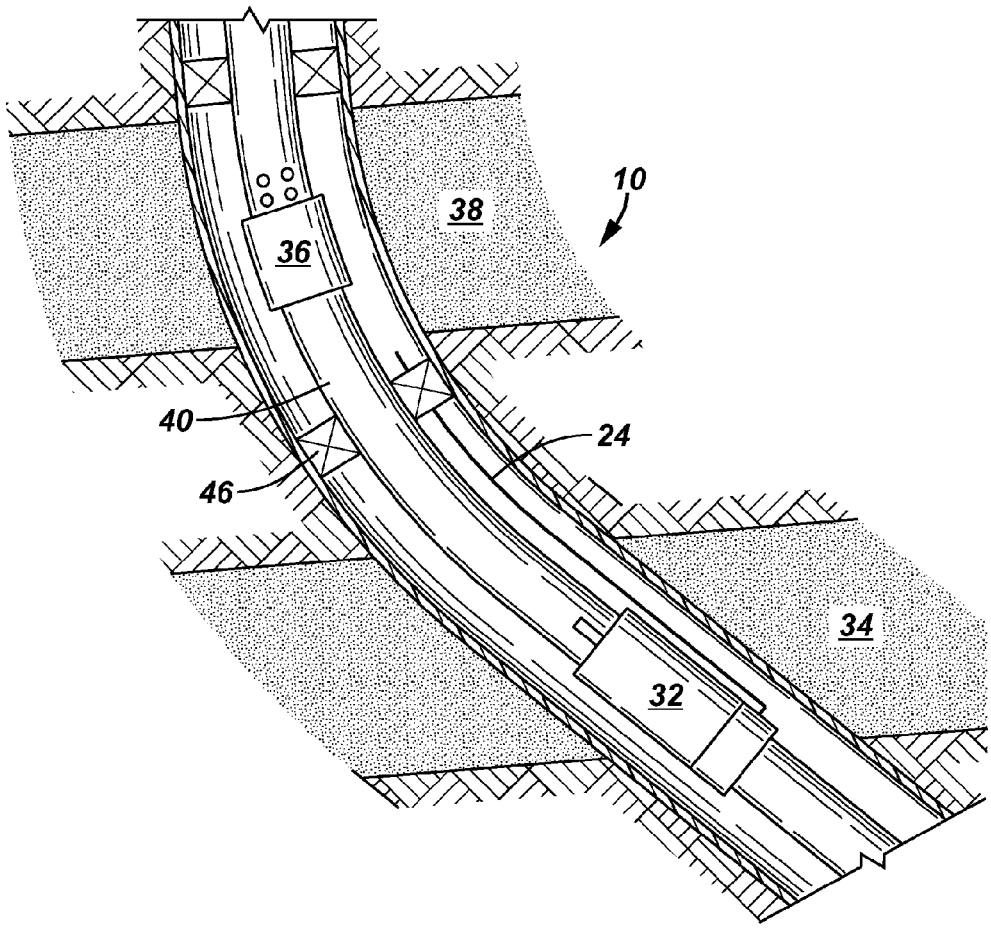
FIG. 2 shows a schematic view of an alternative embodiment of the snorkel device of FIG. 1.

In FIG. 2, an alternative embodiment using snorkel device 10 is shown. In this embodiment, a first flow control device 32 is located in a high-pressure production zone 34 and a second flow control device 36 is located in a low-pressure production zone 38. Flow control devices 32, 36 selectively control the inflow of formation fluids into a production tubing 40, but snorkel device 10 is not limited to those devices and may be used in safety valves and gas lift valves, as well as other devices.

Because high-pressure production zone 34 is at a higher pressure than low-pressure production zone 38, formation fluids from high-pressure production zone 34 need to be choked back so they may be introduced into tubing 40 at substantially the same pressure as that in low-pressure production zone 38. Equalizing the pressure reduces the possibility of cross-flow between the formations. Although only two production zones are discussed in this example, other production zones may be present and the scope of the present invention includes those additional zones.

Figure 3:
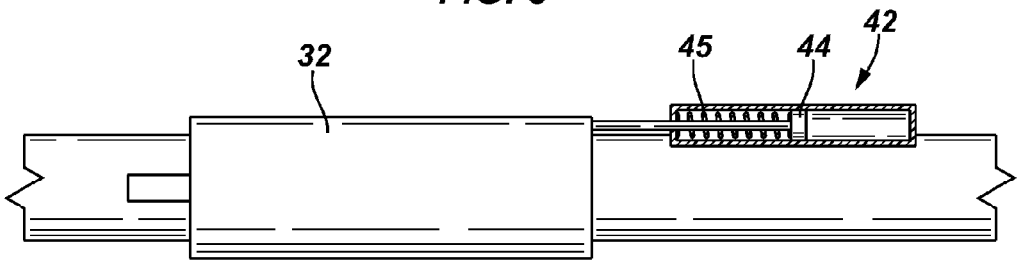
FIG. 3 shows a schematic view of a flow control device used in the embodiment of the snorkel device of FIG. 2.

FIG. 3 shows first flow control device 32 with a proportional controller 42 to adjust the flow area based upon the differential pressure between high-pressure production zone 34 and low-pressure production zone 38. Proportional controller 42 uses differential areas and a spring 45 to adjust the flow area into production tubing 40 via flow control device 32.

Proportional controller 42 may take many forms. In the example shown in FIG. 3, pressure from high-pressure zone 34 acts on a first side of a piston 44. A second side of piston 44 is acted on by a combination of pressure from low-pressure production zone 38 and a spring force. The spring force may be from, for example, mechanical spring 45 or a gas charge. Displacement of piston 44 changes the position of controller 42, which causes flow control device 32 to cover or uncover flow openings into production tubing 40, thereby decreasing or increasing flow. Depending on the particular design of the flow openings and spring selected, flow control device 32 may behave linearly or non-linearly with respect to fluid flow (and correspondingly, pressure drop) as a function of piston displacement.

The pressure from low-pressure production zone 38 is communicated to the second side of piston 44 by snorkel tube 24. Snorkel 24 is run through an isolation packer 46 separating zones 34, 38. Thus, the position of controller 42 is based on the differential pressure between high-pressure production zone 34 and low-pressure production zone 38. If formation pressures should change over time, controller 42 will automatically adjust to compensate and maintain the pressure balance.

Flow from low-pressure production zone 38 enters tubing 40 via second flow control device 36. Second flow control device 36 may be any of various conventional devices such as sliding sleeves, slotted pipe, or perforated pipe.

As in the embodiment of FIG. 1, a compensator 30 may be joined to snorkel 24 to isolate formation fluids from fluid within snorkel 24 in the embodiment of FIG. 2. A tubing pressure override device (not shown) could be included to allow flow control devices 32, 36 to be run into the well in an open or closed position and subsequently be activated by applying tubing pressure. Gas or water detectors may also be incorporated to trigger the operation of a flow control device to reduce or eliminate flow from a particular zone.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A snorkel device for use in a well comprising:

a flow control device; and a snorkel in fluid communication with the flow control device to provide a reference pressure for operating the flow control device, the snorkel extending to another zone in the well to serve as a pressure regulator for the flow control device such that pressure equalization and pressure adjustment during changes in well pressure can be performed automatically, wherein the snorkel terminates above a packer.

2. The snorkel device of claim 1 further comprising a compensator joined to the snorkel.

3. The snorkel device of claim 1 in which the flow control device has multiple state positions.

4. The snorkel device of claim 3 further comprising a control line in fluid communication with the flow control device and in which fluid pressure in the control line and the snorkel operates to change the state position of the flow control device.

5. A snorkel device for flow control in a well comprising:

a plurality of flow control devices, each flow control device being in fluid communication with a distinct control line;

a snorkel in fluid communication with each flow control device; and a compensator joined to the snorkel.

6. The snorkel device of claim 5 in which the snorkel terminates above a packer.

7. The snorkel device of claim 5 in which each flow control device has multiple state positions.

8. The snorkel device of claim 7 in which the state position of each flow control device is changed by increasing or decreasing the pressure in the control line above or below the pressure in the snorkel.

9. The snorkel device of claim 5 in which pressure in the snorkel is manipulated at the surface of the well.

10. The snorkel device of claim 5 in which the flow control devices are joined to a tubing and the tubing is joined to a packer through which the control lines and snorkel pass.

11. A method to operate a flow control device in a well comprising:

placing the flow control device in a desired location in the well, the flow control device being joined to a control line and a snorkel;

cycling the pressure in the control line above and below the pressure in the snorkel to change the state of the flow control device;

isolating fluid in the snorkel from well fluids using a compensator; and setting a packer through which the control line and snorkel pass.

12. A method to establish a reference pressure for a tool in a well comprising:

using a snorkel to transfer fluid pressure from one location in the well to another location in the well; and distributing the reference pressure via the snorkel to various tools in the well.

13. The method of claim 12 further comprising applying pressure in the well annulus from the surface to set the reference pressure.

14. A snorkel device for use in a well comprising:

a packer to isolate a first production zone in the well from a second production zone in the well;

a first flow control device located in the first production zone, the first flow control device having a proportional controller; and a snorkel in fluid communication with the first flow control device.

15. The snorkel device of claim 14 in which the snorkel terminates in the second production zone.

16. The snorkel device of claim 14 in which the pressure of the fluid discharged by the first flow control device is substantially the same as the pressure of the fluid in the snorkel.

17. The snorkel device of claim 14 further comprising:

a second flow control device located in the second production zone; and a tubing attached to the first flow control device and to the second flow control device and passing through the packer;

in which the pressure of the fluid entering the tubing from the first production zone is substantially equal to the pressure of the fluid entering the tubing from the second production zone.

* * * * *